United States Patent [19]

Gregory

[11] Patent Number: 4,774,384

[45] Date of Patent: Sep. 27, 1988

[54] SAFETY COVER FOR ELECTRICAL OUTLETS

[76] Inventor: Eric J. Gregory, 6414 Anndon Pl., Victoria, V8Z 5R8, Canada

[21] Appl. No.: 58,034

[22] Filed: Jun. 4, 1987

[51] Int. Cl.[4] ..... H01R 13/447

[52] U.S. Cl. ..... 174/67; 439/136

[58] Field of Search ..... 174/67; 220/242; 439/133, 135-140, 142, 144, 147

[56] References Cited

U.S. PATENT DOCUMENTS

| | | | |
|---|---|---|---|
| 2,820,842 | 1/1958 | Meistrell | 174/67 |
| 2,988,242 | 6/1961 | Kneip | 174/67 X |
| 3,068,442 | 12/1962 | Kubik et al. | 174/67 X |
| 4,605,270 | 8/1986 | Aslizadeh | 439/140 |
| 4,607,136 | 8/1986 | Thomas | 174/67 |
| 4,640,564 | 2/1987 | Hill | 439/137 |
| 4,711,634 | 12/1987 | Antone, II et al. | 174/67 X |

FOREIGN PATENT DOCUMENTS 908786 8/1972 Canada .

*Primary Examiner*—Arthur T. Grimley
*Assistant Examiner*—David A. Tone
*Attorney, Agent, or Firm*—Barrigar & Oyen

[57] ABSTRACT

A safety cover plate for electrical outlets is disclosed which has a spring-biased cover plate. The plate slides on short legs which also bias the plate in a vertical direction. The plate slides between an open fixed position, and a closed fixed position.

6 Claims, 4 Drawing Sheets

SAFETY COVER FOR ELECTRICAL OUTLETS

The invention relates to cover plates for electrical outlets, and more particularly to a cover plate which has spring biased safety panels which cover the receptacles when the receptacles are not in use.

BACKGROUND OF THE INVENTION

The standard electrical outlet in the interior of a building provides a safety hazard to children as the unguarded receptacle is open to probing with objects and fingers which may result in electrocution. Consequently various designs have been proposed for safety covers which allow an adult ready access to the receptacle but close the receptacle to children when the receptacle is not in use.

For example, U.S. Pat. No. 2,820,842 issued Jan. 21, 1958 to Meistrell discloses a safety cover plate for electrical receptacles which has shutters which slide in a horizontal direction across the outlet faces. The shutters have slots for receiving the prongs of the electrical plug and are biased so that normally the slots are out of alignment with the prong-receiving slots of the receptacle. To use the receptacle, the prongs are inserted into the slots on the shutter and the shutter is slid laterally until the slots are in alignment.

U.S. Pat. No. 3,068,442 issued Dec. 11, 1986 to Kubik discloses a safety cover for an electrical wall outlet which has spring-biased slide members which slide in a vertical direction to expose one or both of the electrical receptacles.

U.S. Pat. No. 3,865,456 issued Feb. 11, 1975 to Dola discloses a cover plate for electrical outlets which has similarly two spring-biased vertically sliding shutters which are provided with prong-receiving slots which are normally out of alignment with the underlying receptacle but can be slid into alignment when the receptacle is in use.

U.S. Pat. No. 4,549,778 issued Oct. 29, 1985 to Price discloses a safety electrical outlet cover assembly having a sliding door covering each of the receptacles. The door is slid into and out of position by means of a number of interacting buttons, springs and members.

None of the foregoing devices has shown commercial success for a number of reasons. The Kubik and Price designs require too many elements, adding to the cost of production. In the case of Price, six springs are required. The Meistrell and Dola designs tend to be more difficult to operate, and are less aesthetically pleasing.

The present invention provides an aesthetically pleasing safety cover for electrical outlets which is simple to manufacture and assemble and is difficult for a child to open.

SUMMARY OF THE INVENTION

According to the present invention there is provided a cover assembly for an electrical outlet comprising:

(a) A cover plate provided with an opening able to expose the electrical outlet and having raised stop means for blocking the motion of a cover panel in the plane of the cover plate;

(b) Sliding cover panel means adapted to slide between a first position covering the opening and a second position exposing the opening, the panel being provided with leg means for supporting the panel on a base plate;

(c) A base plate provided with track means for receiving and guiding the legs of the panel, and means for limiting the travel of the panel along the track;

(d) Means for biasing the panel in a closed position; and, (e) Means for biasing the panel in a vertically raised position.

BRIEF DESCRIPTION OF THE DRAWINGS

In drawings which illustrate an embodiment of the invention.

DETAILED DESCRIPTION OF A PREFERRED EMBODIMENT OF THE INVENTION

Figure 1:
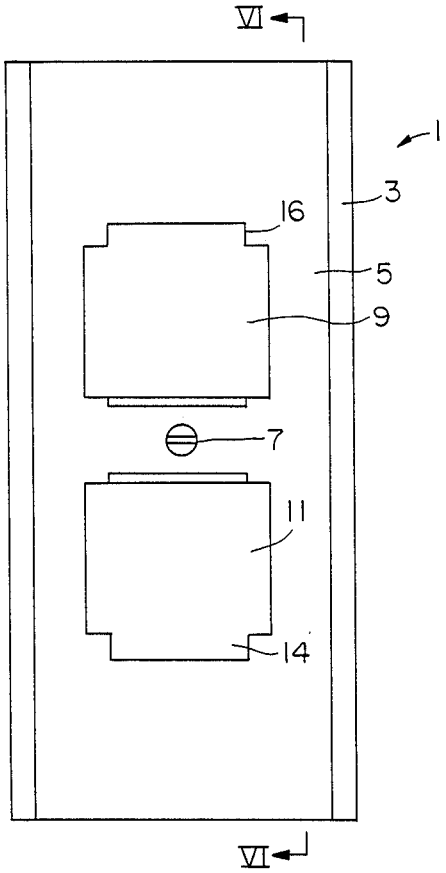
FIG. 1 is a front view of the safety cover of the invention mounted on an electrical socket with sliding panels in the closed position.
Figure 2:
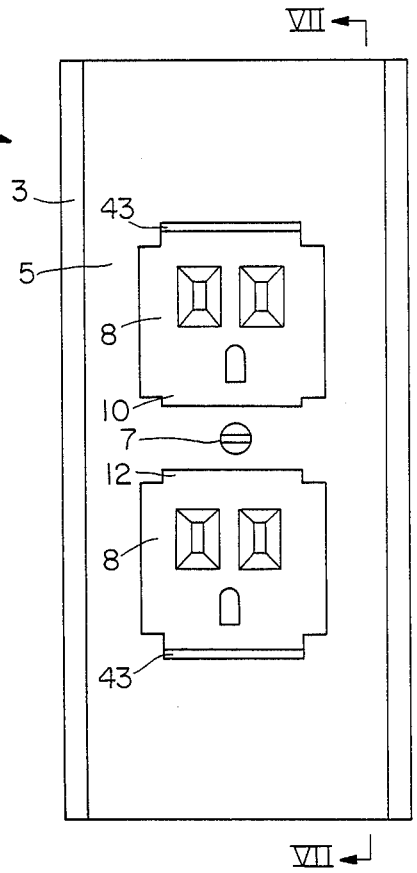
FIG. 2 is a front view of the cover plate of the invention mounted on an electrical socket with sliding panels in the open position.

Referring to FIGS. 1 and 2, the safety cover of the invention is designated generally as 1. It includes a base plate 3 and a cover plate 5. Both base and cover plates are provided with a hole to receive a bolt or screw 7 which secures the cover to the electrical socket mounted in the wall. The cover is provided with two sliding panels 9 and 11. These are shown in closed position in FIG. 1 and open in FIG. 2, thus exposing the two wall-mounted receptacles 8.

Figure 4:
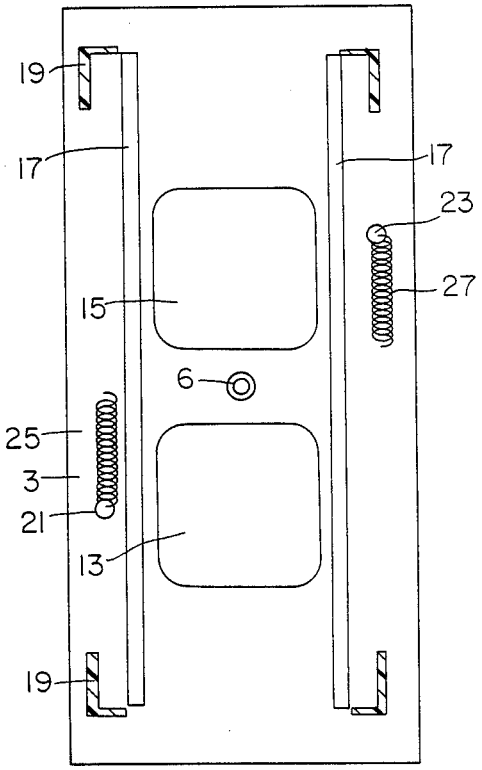
FIG. 4 is a plan view of the top of the base plate of the invention.

Referring to FIG. 4, the base plate 3 is provided with hole 6 for receiving screw 7. It is further provided with two apertures 13 and 15 sized to allow access to the two underlying receptacles. Base plate 3 is also provided with two parallel tracks or grooves 17 and raised corners 19, the functions of which will be described further below. Also provided on the base plate 3 are two pins 21 and 23 for securing the end of springs 25 and 27.

Figure 3:
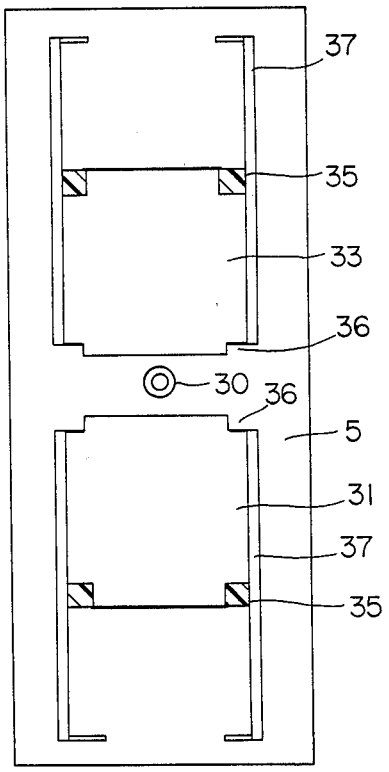
FIG. 3 is a plan view of the underside of the cover plate of the invention.

FIG. 3 shows the underside of cover plate 5. Apertures 31 and 33 are sized to match the shape of sliding panels 9 and 11. Hole 30 is adapted to receive screw or bolt 7. Square portions 35 are slightly raised above the surface of the underside of cover plate 5. Parallel ridges 37 project from the underside of the cover plate and are sized to receive the panel portion 45 of one of the sliding panels 9 and 11 between them.

Figure 5:
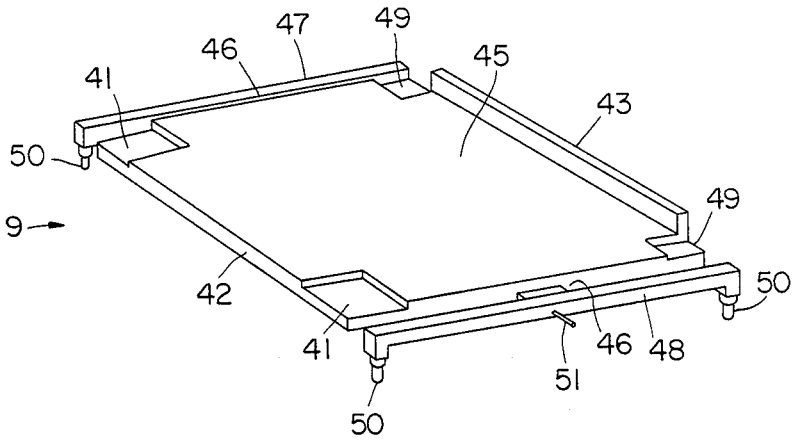
FIG. 5 is a perspective view of the sliding panel of the invention.

Referring to FIG. 5, sliding panel 9 has recesses 41 and 49 and raised front extension 43 extending vertically upwardly from the end of flat surface 45. Recesses 41 are slightly deeper than recesses 49. Surface 45 is joined by extension 46 to legs 47 and 48 which have connected to either end vertical posts 50. Legs 47 and 48 are constructed of a flexible plastic such as is sold under the trademark DELRIN or similar material which causes panel 9 to spring upwardly in a vertical direction when depressed in the center. A pin 51 extends horizontally at right angles to leg 48 and receives the end of a spring 27. The entire panel assembly, including legs and posts 50 may be moulded from a single piece of the DELRIN plastic.

In operation, panels 9 and 11 are positioned so that posts 50 run along tracks 17 to guide the motion of the panels. Springs 25 and 27 are connected to posts 21 and 23 and pins 51 to bias the panels in a closed position. The height of cover plate 5 and the vertical extension of legs 47 and 48 are such that the top surface 45 of panels 9 and 11 are forced upwardly into apertures 31 and 33 when the panels are in the closed position. The panels are thus held snugly in place, with vertical extensions 43 bearing snugly against the edges of notches 10 and 12, and corners 35 and 36 fitting in recesses 41 and 49.

In order to open the sliding panels and expose the underlying receptacles, it is necessary to press down on panels 9 and 11, thereby depressing the central section of legs 47 and 48, so that the top of the panel can clear raised squares 35. The panel is then slid along tracks 17 and along ridges 37, until edge 42 of the panel bears against the perpendicular end of ridges 37. At this point recesses 49 in the opposite end 43 are aligned with raised squares 35 and the spring-like legs force the panel again into a locked position, with raised section 35 fitting into notches 49 and raised section 43 fitting into notches 14 and 16. In this position the receptacles are exposed. The sliding panels can be returned to the closed position by simply depressing the panels which allows the top surface 45 to clear the raised section 35 and springs 25 and 27 will return the panels to the closed position. Similarly, when the panels are opened and a plug is inserted into the receptacle, the panel can be released from its open position so that when the plug is removed the panel automatically closes over the aperture.

Figure 6:
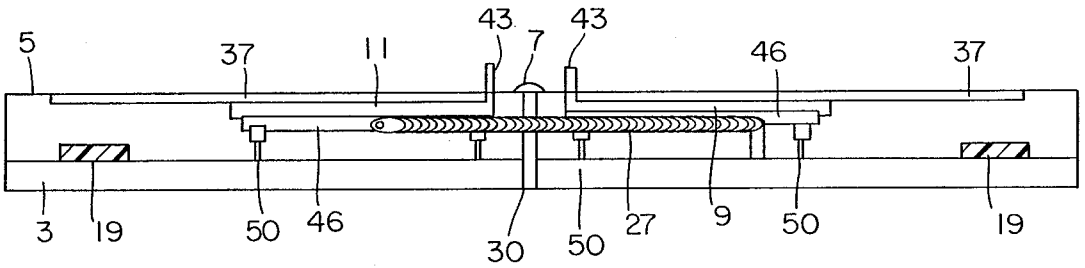
FIG. 6 is a cross-sectional view (not to scale) taken along lines of FIG. 1; and, FIG. 7 is a cross-sectional view (not to scale) taken along lines VII—VII of FIG. 2.
Figure 7:
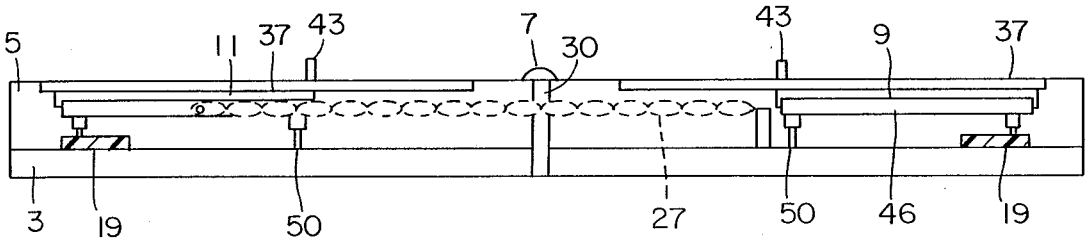

FIGS. 6 and 7 illustrate in simplified schematic form the position of the sliding panels 9 and 11 in the closed and open configurations respectively. Spring 25 which biases panel 9 is not depicted for purposes of clarity. In FIG. 6, panel 11 is fitting flush in aperture 31, with any further movement to reduce the tension on spring 27 being prevented by projection 43. FIG. 7 shows panel 11 having been depressed to clear raised portion 35 and slid horizontally until raised portions 35 can sit in recesses 49, holding the panel in open position with spring 27, shown in dotted outline, extended.

While various adaptations and modifications of the structure above described will be apparent to those skilled in the art, the scope of the invention should be defined in terms of the attached claims.

I claim:

1. A cover assembly for an electrical outlet comprising:

(a) a cover plate provided with an opening adapted to expose an electrical outlet and having raised stop means on the underside of said cover plate for blocking the motion of a cover panel in the plane of the cover plate;

(b) sliding cover panel means adapted to slide between a first position covering said opening and a second position exposing said opening, said panel being provided with leg means for supporting said panel on a base plate;

(c) a base plate provided with track means for receiving and guiding said legs and said panel and the means for limiting the travel of said panel along said track;

(d) means for biasing said panel toward a closed position; and, (e) means for biasing said panel toward said cover plate.

2. The cover assembly of claim 1 wherein said leg means provide said means for biasing the panel toward said cover plate.

3. The cover assembly of claim 2 wherein said leg means comprise a horizontally extended element running parallel to the edge of said panel on each side of said panel, each said element being joined to said panel in a central location and having vertically extending support means extending downwardly from either end of said element.

4. The cover assembly of claim 1 wherein said means for blocking the motion of said cover panel comprise raised sections on the undersurface of said coverplate adjacent said opening.

5. The cover assembly of claim 4 wherein said cover panel comprises a vertically extended ridge along the forward edge of said cover panel.

6. The cover assembly of claim 1 wherein said cover panel is provided with a recess for receiving said stop means thereby securing said cover panel in a fixed position.

* * * * *